US006822628B2

(12) United States Patent
Dunphy et al.

(10) Patent No.: US 6,822,628 B2
(45) Date of Patent: Nov. 23, 2004

(54) METHODS AND SYSTEMS FOR COMPENSATING ROW-TO-ROW BRIGHTNESS VARIATIONS OF A FIELD EMISSION DISPLAY

(75) Inventors: James C. Dunphy, San Jose, CA (US); William Cummings, San Francisco, CA (US); Christopher J. Spindt, Menlo Park, CA (US); Ronald L. Hansen, San Jose, CA (US); Jun (Gordon) Liu, Fremont, CA (US); Lee Cressi, Morgan Hill, CA (US); Colin Stanners, San Jose, CA (US)

(73) Assignees: Candescent Intellectual Property Services, Inc., Los Gatos, CA (US); Candescent Technologies Corporation, Los Gatos, CA (US)

( * ) Notice: Subject to any disclaimer, the term of this patent is extended or adjusted under 35 U.S.C. 154(b) by 179 days.

(21) Appl. No.: 09/895,985

(22) Filed: Jun. 28, 2001

(65) Prior Publication Data

US 2003/0011537 A1 Jan. 16, 2003

(51) Int. Cl.[7] ..... G09G 3/22
(52) U.S. Cl. ..... 345/75.2; 345/207; 315/169.1
(58) Field of Search ..... 345/75.2, 63, 77, 345/211, 102, 531, 204, 207, 74.1, 75.1; 315/169.1, 169.3

(56) References Cited

U.S. PATENT DOCUMENTS 5,262,698 A 11/1993 Dunham ..... 315/169.4
5,708,451 A * 1/1998 Baldi ..... 345/75.2
6,097,356 A * 8/2000 Fan ..... 345/60
6,140,985 A * 10/2000 Kanai et al. ..... 345/74.1
6,329,759 B1 * 12/2001 Tanaka et al. ..... 315/169.3
6,392,355 B1 * 5/2002 Palmer et al. ..... 315/169.1
6,462,484 B2 10/2002 Dumphy et al. ..... 315/169.3
6,465,966 B2 * 10/2002 Konuma ..... 315/169.1

* cited by examiner

*Primary Examiner*—Regina Liang
*Assistant Examiner*—Jennifer T. Nguyen
(74) *Attorney, Agent, or Firm*—Wagner, Murabito & Hao LLP

(57) ABSTRACT

Methods for compensating for brightness variations in a field emission device. In one embodiment, a method and system are described for measuring the relative brightness of rows of a field emission display (FED) device, storing information representing the measured brightness into a correction table and using the correction table to provide uniform row brightness in the display by adjusting row voltages and/or row on-time periods. A special measurement process is described for providing accurate current measurements on the rows. This embodiment compensates for brightness variations of the rows, e.g., for rows near the spacer walls. In another embodiment, a periodic signal, e.g., a high frequency noise signal, is added to the row on-time pulse in order to camouflage brightness variations in the rows near the spacer walls. In another embodiment, the area under the row on-time pulse is adjusted to provide row-by-row brightness compensation based on correction values stored in a memory resident correction table. In another embodiment, the brightness of each row is measured and compiled into a data profile for the FED. The data profile is used to control cathode burn-in processes so that brightness variations are corrected by physically altering the characteristics of the emitters of the rows.

8 Claims, 12 Drawing Sheets

60

510 520

| ROW # | CORRECTION VALUE |
|---|---|
| 1 | C1 |
| 2 | C2 |
| 3 | C3 |
| 4 | C4 |
| * * * | * * * |
| N | CN |

FILTER

FIG. 9

METHODS AND SYSTEMS FOR COMPENSATING ROW-TO-ROW BRIGHTNESS VARIATIONS OF A FIELD EMISSION DISPLAY

FIELD OF THE INVENTION

The present invention pertains to the field of flat panel display screens. More specifically, the present invention relates to the field of brightness corrections for flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This allows the distance from the electron source to the screen to be very small compared to the distance required for the scanning electron beams of the conventional CRTs. In addition, FEDs consume far less power than CRTs. These factors make FEDs ideal for portable electronic products such as laptop computers, pagers, cell phones, pocket-TVs, personal digital assistants, and portable electronic games.

One problem associated with the FEDs is that the FED vacuum tubes may contain minute amounts of contaminants which can become attached to the surfaces of the electron-emissive elements, faceplates, gate electrodes, focus electrodes, (including dielectric layer and metal layer) and spacer walls. These contaminants may be knocked off when bombarded by electrons of sufficient energy. Thus, when an FED is switched on or switched off, there is a high probability that these contaminants may form small zones of high pressure within the FED vacuum tube.

Within an FED, electrons may also hit spacer walls and focus electrodes, causing non-uniform emitter degradation. Problems occur when electrons hit any surface except the anode, as these other surfaces are likely to be contaminated and out gas.

The problems associated with contaminants, electron bombardment and out gassing can lead to brightness variations from row-to-row in an FED device. These brightness variations can be most pronounced around the rows that are nearby spacer walls. Spacer walls are placed between the anode and emitters of an FED device and help maintain structural integrity under the vacuum pressure of the tube. One cause of brightness variations of rows nearby spacer walls results from a non-uniform amount of contaminants falling onto the emitters that are located near spacer walls. More contaminants falling on these emitters makes rows dimmer or brighter that are located nearby the spacer walls.

Another factor leading to brightness variations row-to-row is that electrons may strike the spacer walls thereby causing ions to be released which migrate to the emitters. These ions may make the rows closer to the spacer walls actually get brighter. Also, over the life of the tube, gasses exit the faceplate and the existence of the spacer walls causes a reduced amount of these gasses to be absorbed by the emitters near the spacer walls compared to those emitters that are located farther away from the spacer walls. As a result, the cathodes of the emitters located near the spacer walls are left in relatively good condition thereby leading to brighter rows near the spacer walls.

Unfortunately, the human eye is very sensitive to brightness variations of rows that are close together. These variations can cause visible artifacts in the display screen that degrade image quality.

It would be advantageous to reduce or eliminate brightness variations of the rows of an FED device. More specifically, it would be advantageous to reduce or eliminate brightness variations for rows located nearby spacer walls.

SUMMARY OF THE DISCLOSURE

Accordingly, the embodiments of the present invention reduce or eliminate brightness variations of the rows of an FED device. More specifically, embodiments of the present invention reduce or eliminate brightness variations for rows located nearby spacer walls. Also, embodiments of the present invention provide an accurate method of measuring brightness variations of an FED device row-to-row. These and other advantages of the present invention not specifically described above will become clear within discussions of the present invention herein.

Methods are described for compensating for brightness variations in a field emission device. In one embodiment, a method and system are described for measuring the relative brightness of rows of a field emission display (FED) device, storing information representing the measured brightness into a correction table and using the correction table to provide uniform row brightness in the display by adjusting row voltages and/or row on-time periods. A special measurement process is described for providing accurate current measurements on the rows. This embodiment compensates for brightness variations of the rows, e.g., for rows near the spacer walls. In another embodiment, a periodic signal, e.g., a high frequency noise signal is added to the row on-time pulse in order to camouflage brightness variations in the rows near the spacer walls. In another embodiment, the area under the row on-time pulse is adjusted using a number of different pulses shaping techniques to provide row-by-row brightness compensation based on correction values stored in a memory resident correction table. In another embodiment, the brightness of each row is measured and compiled into a data profile for the FED. The data profile is used to control cathode burn-in processes so that brightness variations are corrected by physically altering the characteristics of the rows.

More specifically, in a field emission display (FED) device comprising: rows and columns of emitters; an anode electrode; and spacer walls disposed between the anode electrode and the emitters, one embodiment of the present invention is directed to a method of measuring display attributes of the FED device comprising the steps of: a) in a progressive scan fashion, sequentially driving each row and measuring the current drawn by each row, wherein a settling time is allowed after each row is driven; b) measuring a background current level during a vertical blanking interval; c) correcting current measurements taken during the step a) by the background current level to yield corrected current measurements; d) averaging multiple corrected current measurements taken over multiple display frames to produce averaged corrected current values for all rows of the FED device; and e) generating a memory resident correction table based on the averaged corrected current values.

In a field emission display (FED) device comprising: rows and columns of emitters; an anode electrode; and spacer walls disposed between the anode electrode and the emitters, another embodiment of the present invention includes a method of driving the FED device comprising the steps of: a) generating a correction signal that is periodic in nature; b) adding the correction signal to a row driving pulse to generate a corrected row driving pulse; c) using the corrected row driving pulse to drive a row of the rows for a row on-time period; and d) generating a display frame by repeating steps a)–c) for each of the rows and wherein the correction signal functions to camouflage any non-uniformities of display brightness associated with rows that are positioned near the spacer walls.

In a field emission display (FED) device comprising: rows and columns of emitters; an anode electrode; and spacer walls disposed between the anode electrode and the emitters, another embodiment of the present invention includes a method of driving the FED device comprising the steps of: a) accessing a memory resident correction table to obtain a row correction value for a given row, the correction table containing a respective correction value for each of the rows, the correction values used to adjust the brightness of the rows on a row-by-row basis to correct for any brightness non-uniformities of the rows; b) applying the correction value, of the given row, to a row on-time pulse to generate a corrected row on-time pulse; c) driving the given row with the corrected row on-time pulse; and d) displaying a frame by repeating the steps a) and c) for each of the rows.

Another embodiment of the present invention includes a field emission display (FED) device comprising: rows and columns of emitters; an anode electrode; spacer walls disposed between the anode electrode and the emitters, a memory resident correction table for supplying a respective correction value for each of the rows, the memory resident correction table for providing row-by-row brightness correction to compensate for row brightness variations near the spacer walls; a correction circuit coupled to the memory resident correction table and for applying correction values from the correction table to row on-time pulses to generate corrected row on-time pulses; and driver circuitry coupled to the correction circuit for driving the rows with the corrected row on-time pulses.

Another embodiment of the present invention is directed at a method of compensating for brightness variations within a field emission display (FED) device comprising: rows and columns of emitters; an anode electrode; and spacer walls disposed between the anode electrode and the emitters, the method comprising the steps of: a) generating a data profile for the FED by measuring the brightness of each row of the rows and storing therein a respective value for each row; and b) based on the data profile, performing a cathode burn-in process that alters the physical characteristics of the rows to compensate for brightness variations depicted in the data profile.

BRIEF DESCRIPTION OF THE DRAWINGS

The accompanying drawings, which are incorporated in and form a part of this specification, illustrate embodiments of the present invention and, together with the description, serve to explain the principles of the invention.

FIG. 9 is a memory resident look-up table containing brightness correction values having one respective correction value for each row.

DETAILED DESCRIPTION OF THE PREFERRED EMBODIMENTS

Reference will now be made in detail to the present embodiments of the invention, examples of which are illustrated in the accompanying drawings, and include methods and systems for providing row-to-row brightness corrections in an FED device. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

Figure 1:
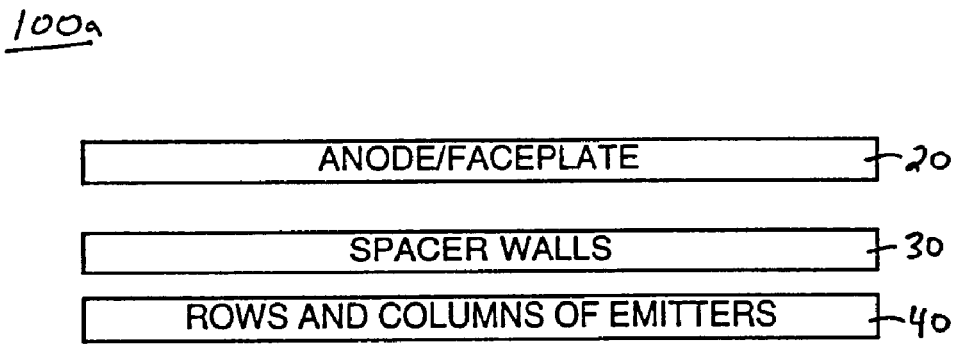
FIG. 1 illustrates a cross sectional view of a simplified field emission display (FED) device.

FIG. 1 illustrates a cross section of an exemplary field emission display (FED) device 100*a*. The FED device 100*a* contains a high voltage faceplate or anode 20 having phosphor spots thereon. Spacer walls 30 are disposed between the anode 20 and rows/columns of emitters 40. The spacer walls 30 provide structural integrity for the device 100*a* under the tube's vacuum pressure. In general, FED technology relating to device 100*a* is described in more detail in the following US Patents which are hereby incorporated by reference: U.S. Pat. No. 6,037,918 (application Ser. No. 09/050,664); U.S. Pat. No. 6,051,937 (application Ser. No. 09/087,268); U.S. Pat. No. 6,133,893 (application Ser. No. 09/144,213); U.S. Pat. No. 6,147,664 (application Ser. No. 09/164,402); U.S. Pat. No. 6,166,490 (application Ser. No. 09/318,591); U.S. Pat. No. 6,153,986 (application Ser. No. 09/470,674); U.S. Pat. No. 6,169,529 (application Ser. No. 09/050,667); and U.S. Pat. No. 6,104,139 (application Ser. No. 09/144,675).

The emitters 40 of FIG. 1 are electron emissive elements. One type of electron-emissive element 40 is described in U.S. Pat. No. 5,608,283, issued on Mar. 4, 1997 to Twichell et al., and another type is described in U.S. Pat. No. 5,607,335, issued on Mar. 4, 1997 to Spindt et al., which are both incorporated herein by reference. The tip of the electron-emissive element is exposed through a corresponding opening in a gate electrode. The above FED configuration 100*a* is also described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are also incorporated herein by reference.

As described herein, the spacer walls 30 introduce brightness variations from row-to-row in the FED device. Several embodiments of the present invention are described below for compensating for these variations to produce a better displayed image that is free of discernible brightness artifacts caused by the presence of the spacer walls or for other reasons.

Figure 2:
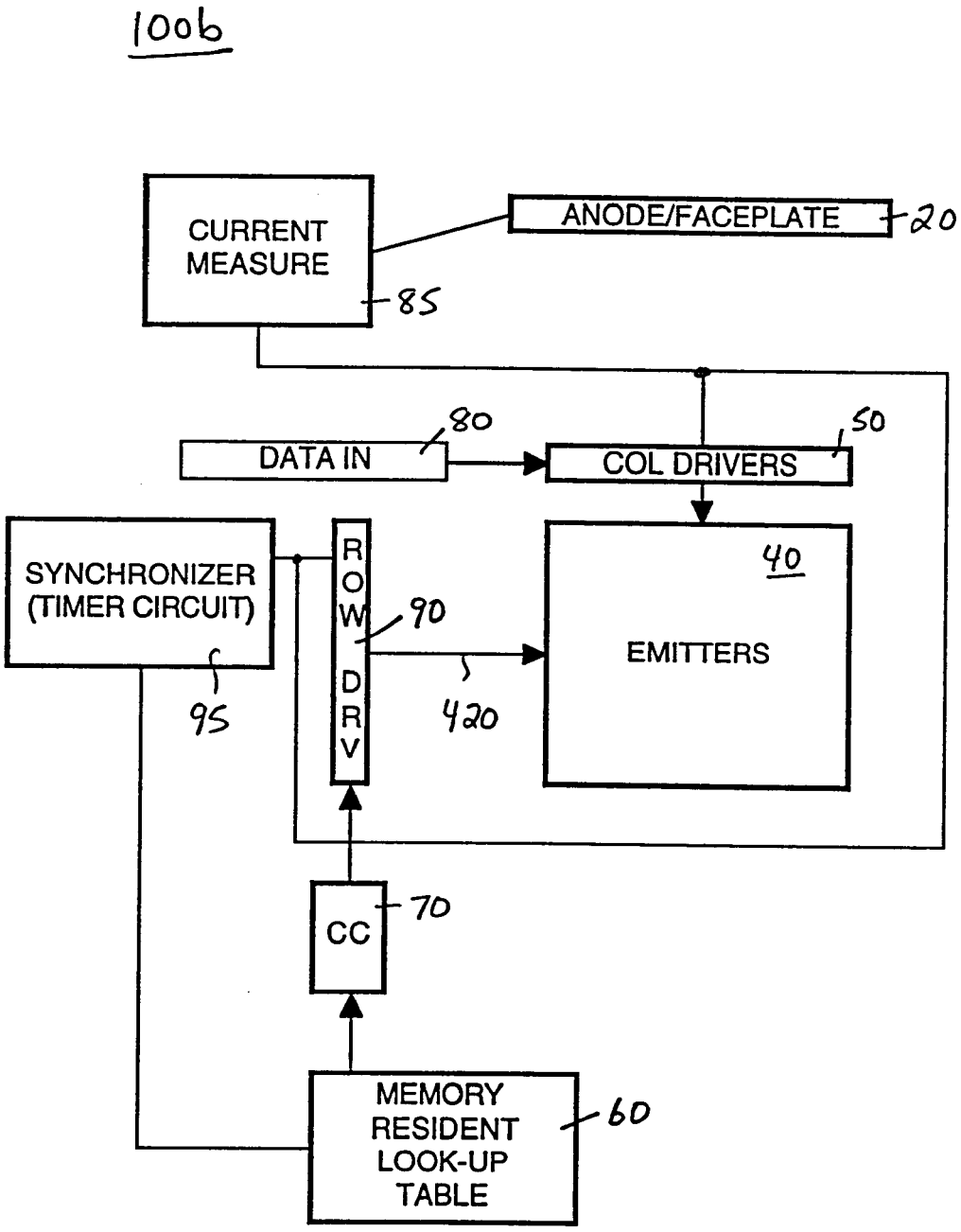
FIG. 2 is a logical block diagram of display circuitry used in accordance with one embodiment of the present invention having a memory resident look-up table to provide row-to-row brightness correction.

In accordance with one embodiment of the present invention, FIG. 2 illustrates a FED device 100*b* having a memory resident look-up table 60 for providing brightness corrections for row-to-row variations. The table 60 stores a respective brightness correction value for each row of the FED device. During a particular row's on-time, its on-time pulse is modified by a correction circuit 70 to produce a corrected on-time pulse 420 that is emitted from the row driver. The correction performed by correction circuit 70 is based on a correction value supplied by table 60 that is customized for the particular row. A synchronizer circuit 95 generates the appropriate frame update signals in accordance with well known technology.

Alternatively, correction may be applied by changing the column voltages instead of changing the row voltages, but still synchronized with the row number.

Accurate Row Current Measuring Process

The respective brightness correction values are determined based on accurate electronic measurements also made by device 100*b* in accordance with embodiments of the present invention. While a row is being driven, row brightness is proportional to the current drawn by the anode 20. Therefore, circuit 85 measures the current received by the faceplate or anode 20 in coincidence with a given row being driven. Current of the row can thereby be determined and related to row brightness for each row.

Figure 3A:
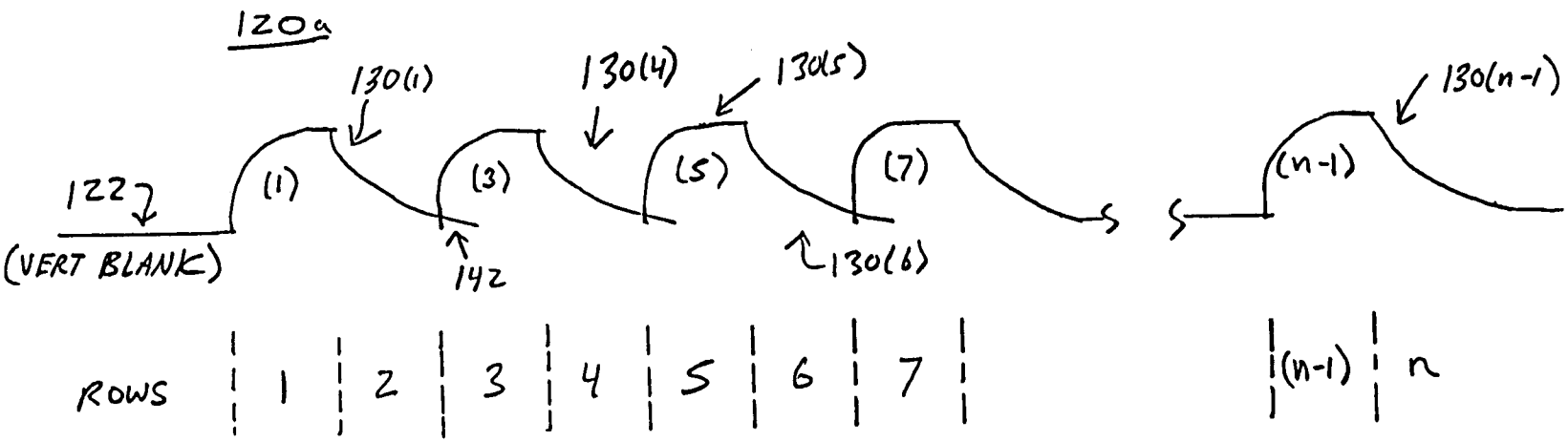
FIG. 3A is a timing diagram illustrating odd rows driven and measured while even rows provide settling time in one implementation of the present invention.
Figure 3B:
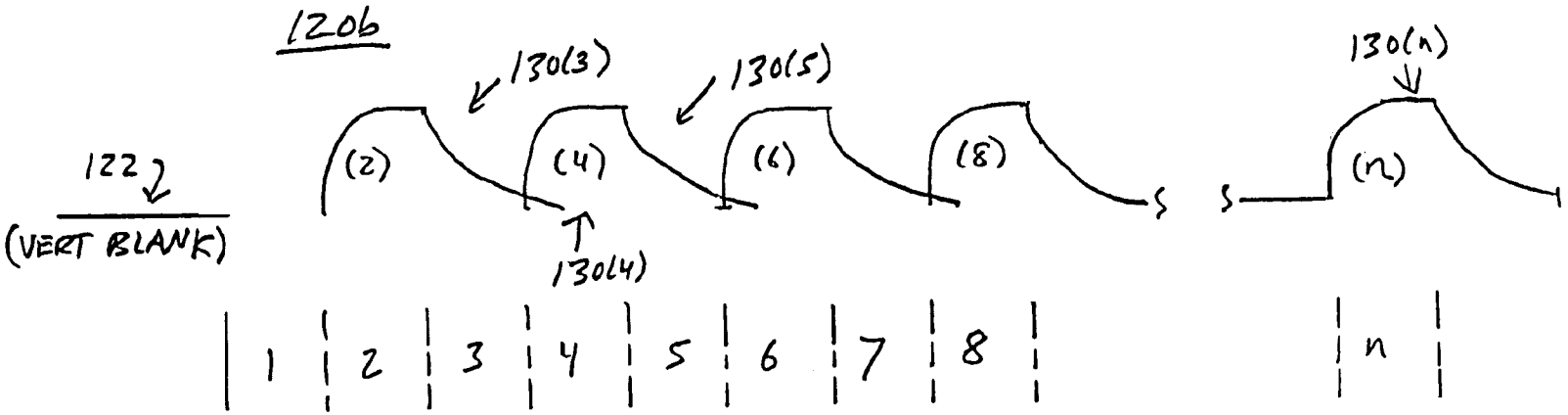
FIG. 3B is a timing diagram illustrating even rows driven and measured while odd rows provide settling time in one implementation of the present invention.
Figure 4:
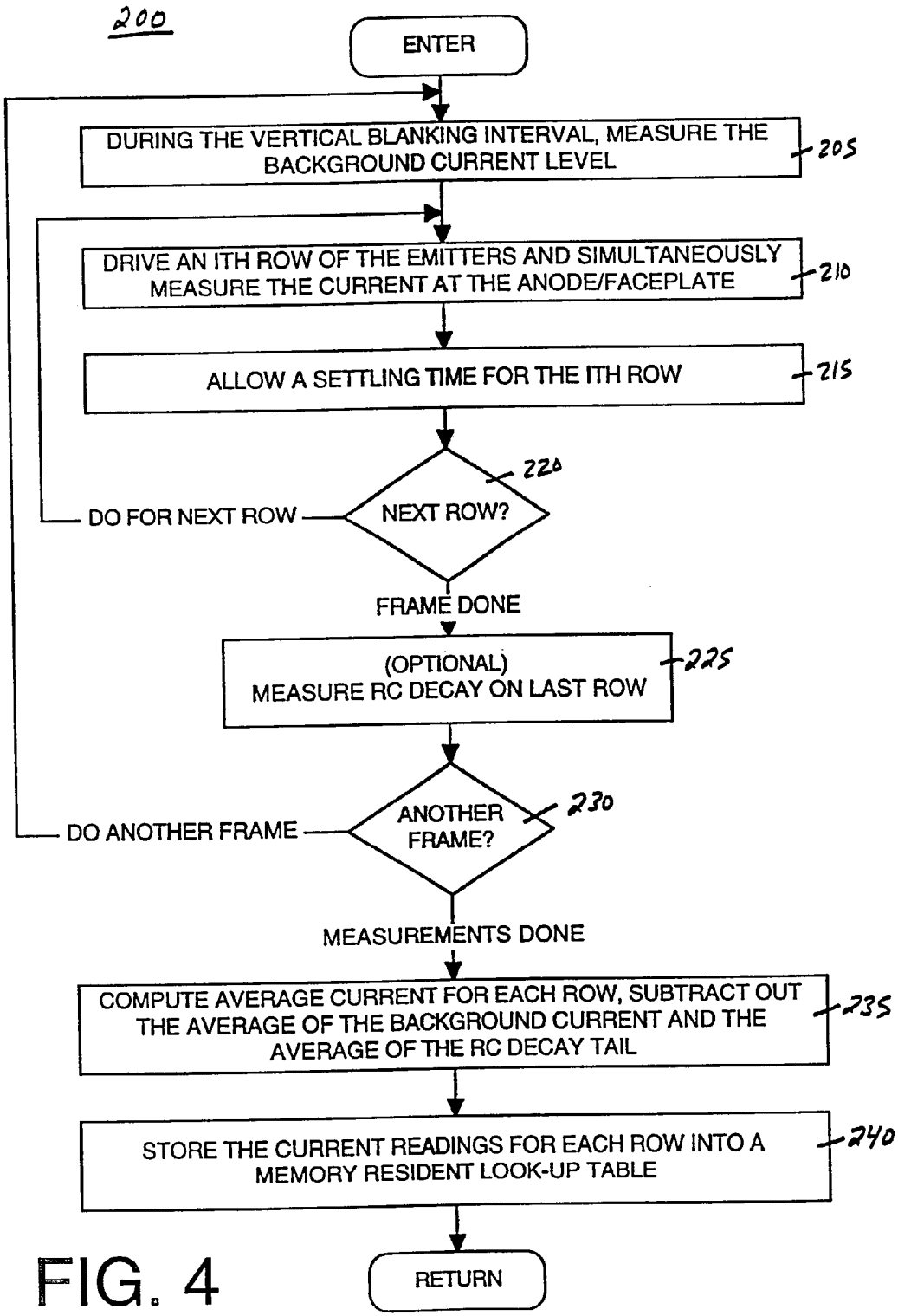
FIG. 4 illustrates a flow diagram of steps performed in accordance with an embodiment of the present invention for generating a memory resident look-up table having row-to-row brightness correction values.

In accordance with an embodiment of the present invention, an accurate current measurement technique is described. FIG. 4 illustrates a flow diagram describing the general measurement process 200. FIG. 3A and FIG. 3B illustrate timing diagrams of an exemplary implementation. It is assumed that during current measurement, a uniform pattern is displayed on the FED device, e.g., an all-white pattern may be used. With respect to FIG. 4, at step 205, the background current drawn through the anode 20 is measured during the vertical blanking interval of a display frame (shown as signal 122 of FIG. 3A and FIG. 3B) and saved. At step 210, a row, e.g., the ith row, of the display is driven and simultaneously the current drawn by the anode 20 is measured by circuit 85. Any number of well known currents measuring circuits can be used for circuit 85 and furthermore circuit 85 may contain an isolator circuit due the high voltage applied to the anode 20.

Importantly, at step 215, a settling time is allowed for the current associated with the ith row to completely decay and be measured. Current measuring continues (for the ith row) through the settling time for each row. After the settling time 215, if more rows need to be measured in the frame, then a next row is selected and processing returns to step 210. If the frame is done, then step 225 determines the RC decay function associated with the current drawn by the last row of the frame. This is done to determine the current "spill over" amount from one row to another. If another frame worth of measurement is required, then step 205 is entered. It is appreciated that all the measurements taken for a given frame are averaged over multiple frames for increased accuracy.

Measurement may also be performed by alternating between measuring even and odd rows.

At step 235 of FIG. 4, process 200 then computes the average measured current for each row of the FED device. Subtracted from these values is the average of the background current value measured by step 205. Additionally, the average of the spill over amount (as determined by step 225) is also subtracted out of each measured row current value. The values for each row are then compared to a brightness standard and the differences there between are stored in a memory resident look-up table at step 240 and indexed by row number. Alternatively, the measured current amounts can be directly stored. Typically, frames are processed at 30 Hz and 1–20 seconds worth of measurement leads to an error of less than 1 percent on the current measurements described herein.

FIG. 3A and FIG. 3B illustrate one implementation of process 200 in accordance with an embodiment of the present invention. As shown by the timing diagram 120*a* of FIG. 3A, odd rows are first driven with even rows not being driven but nevertheless given their allotments of time. The timing diagram 120*a* represents a progressive scan from rows 1 to n. The vertical blanking period 122 is shown and background current through the anode is measured during this period. It is appreciated that the period of time allotted for each even row supplies the settling time for the odd rows, as shown by row2, row4 and row6, for instance. As the odd rows of the frame are driven, their coincident current draw at the anode 20 is measured by circuit 85. Pulse 130(1) illustrates the current measured at the anode 20 in response to row1 being driven. A decay of current follows through the settling time allotted for row2 (which is not driven). The present invention additionally measures this decay current for row1.

A small tail 142 actually leads into the timing for row3. This is the spill over 142 amount for row1. At the end of the frame, the RC decay of the last driven row, row n−1, is measured as shown by pulse 130(*n−1*). This measurement allows the spill over or tail 142 amount to be determined and then it can be subtracted from each row. The current values for each odd row are then reduced by the measured tail amount and also by the background current amount. From frame to frame, the measured values are averaged for increased accuracy.

After the odd rows are measured, the even rows can be measured, or vice-versa. FIG. 3B illustrates a timing diagram 120*b* for the measurement of the even rows with the odd rows not driven but used as settling time periods. Again, the background current is measured during the vertical blanking period 122 and then the current is measured in each even row. The last row, n, is then measured for its RC decay. Like the odd rows, the current is measured for the even rows, and averaged over a number of frames. The results for all measured rows are then stored in the memory resident look-up table.

It is appreciated that the values stored in the memory resident look-up table can be used to adjust the maximum row on-time voltage pulse to eliminate variations in brightness from row-to-row. This can be done for all rows. Alternatively, the row correction circuitry as shown in FIG. 2 can be applied solely to the rows adjacent to the spacer walls. As described more fully below, in lieu of adjusting the row on-time pulse voltage, the period of the row on-time could also be adjusted to provide row-to-row brightness balancing.

Figure 5:
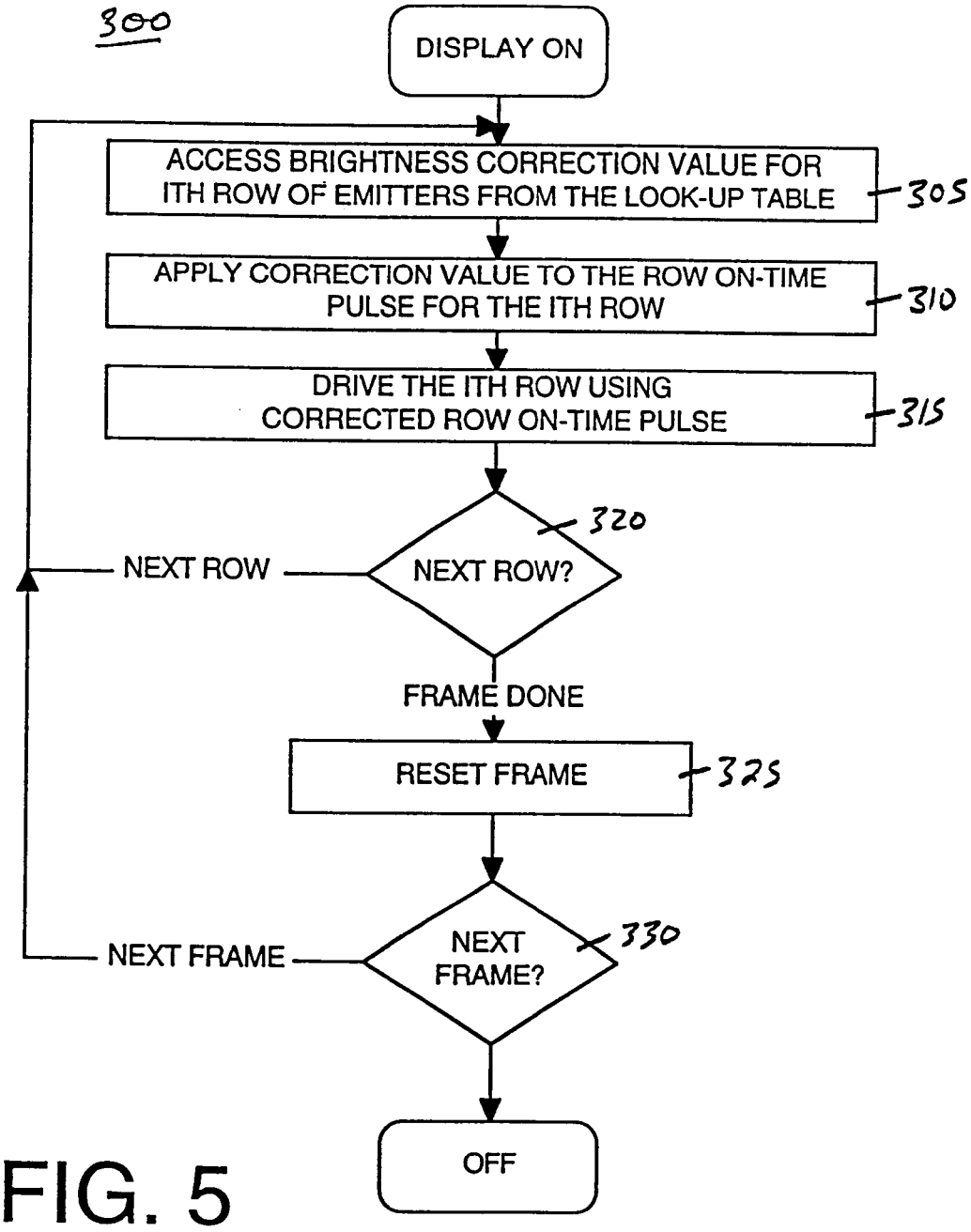
FIG. 5 illustrates a flow diagram of steps performed in accordance with an embodiment of the present invention for display processing using the memory resident look-up table to provide brightness correction in an FED device.

FIG. 5 illustrates a display process 300 that makes use of the memory resident correction table to provide brightness balancing row-to-row. At step 305, a progressive scan is contemplated and rows 1 to n are sequentially driven to display a frame. The ith row is to be driven, and the correction value for the ith row is then obtained from the memory resident correction table using the row number as an index. This value is then applied, at step 310, to adjust the row on-time pulse for the ith row. Either amplitude or pulse width modulation can be performed. The corrected row on-time pulse is then used to drive the ith row at step 315. If this is not the last row of the frame, then step 305 is entered for the next row. It is appreciated that either progressive or interlaced scan can be used.

If the frame is complete, then step 325 is entered where the appropriate frame control signals are reset to allow vertical blanking, etc. If more frames are required, then step 305 is entered again.

Row Current Camouflage Embodiment

Figure 6:
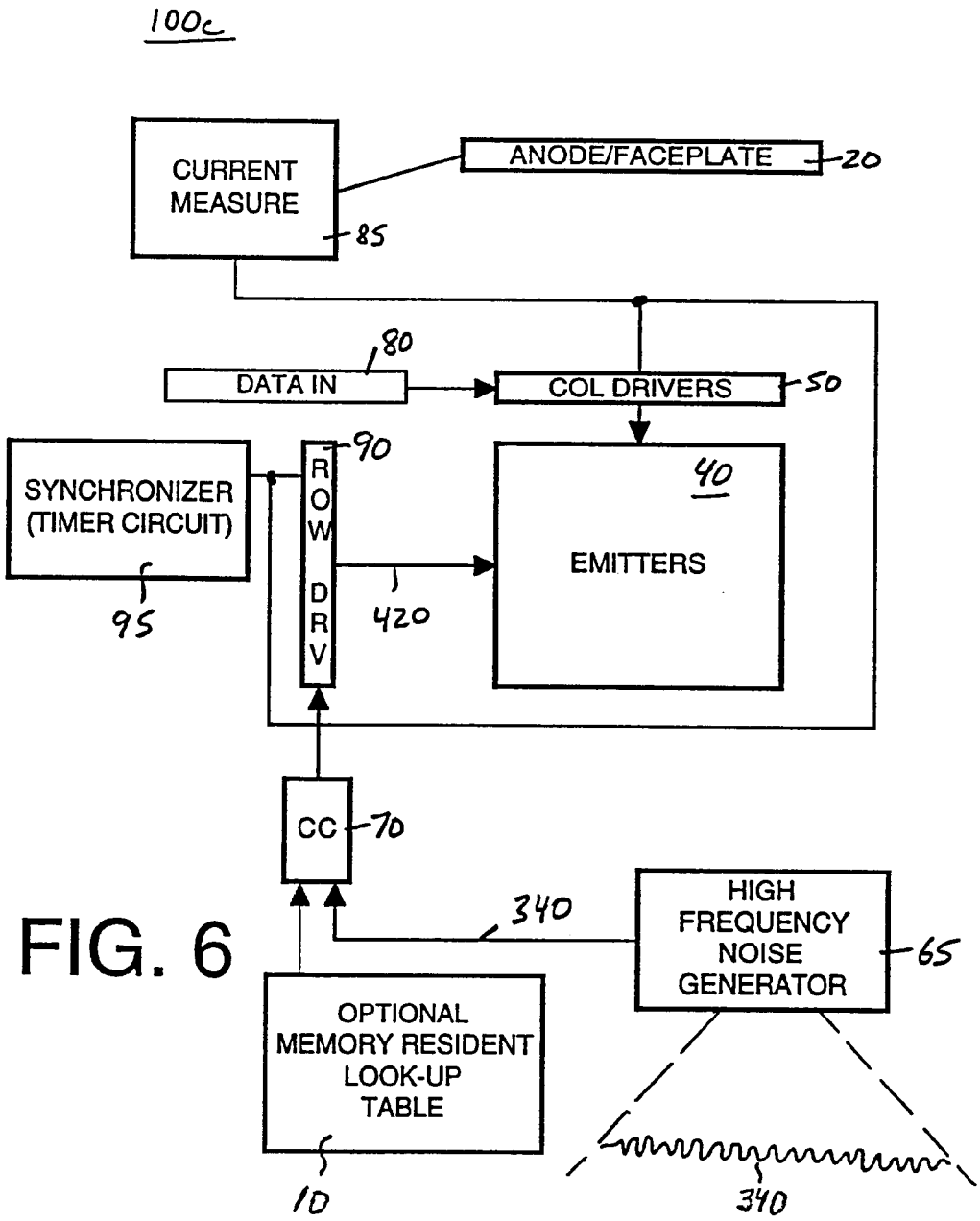
FIG. 6 is a logical block diagram of display circuitry used in accordance with one embodiment of the present invention that provides camouflaged brightness correction by introducing a high frequency noise signal.

FIG. 6 illustrates another embodiment of the present invention for providing row-to-row brightness balancing. This embodiment 100*c* introduces a small amount of noise to each row in order to "camouflage" any brightness variations that occur from row-to-row. In one embodiment, the row voltage amplitude is modulated to introduce the noise amount. The introduction of high frequency noise can be performed in combination with other brightness correction techniques described herein.

Embodiment 100*c* is analogous to embodiment 100*b* (FIG. 2) except for the introduction of high frequency noise generation circuit 65, which generates a high frequency noise signal 340. This noise signal 340 may be periodic in nature and is fed to the correction circuit 70. As shown, optionally, the correction table 60 may also be used. The noise signal 340 is introduced by the correction circuit 70 to slightly alter the row on-time pulses in a pseudo random way. The noise signal is adjusted to a level that helps to camouflage any row-to-row brightness variations (e.g., eliminate perceived row brightness variations) but yet does not cause any perceptible image degradation or artifacts over the area of the display screen. Circuit 65 may be an electronic oscillator circuit having a fixed frequency.

Figure 7:
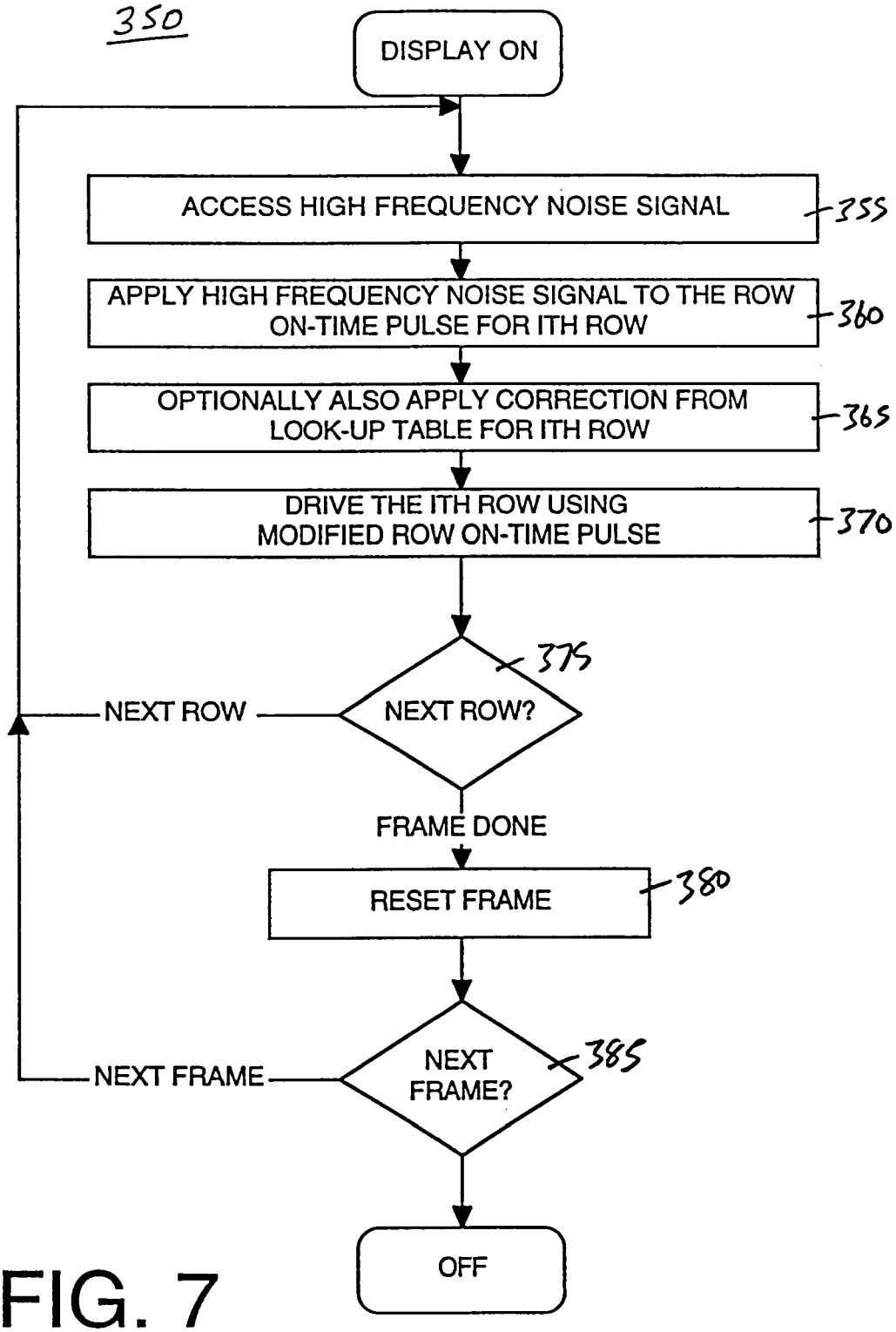
FIG. 7 is a flow diagram of steps performed in accordance with an embodiment of the present invention for performing camouflaged brightness correction by introducing a high frequency noise signal during display processing.

FIG. 7 illustrates a display process 350 utilizing the embodiment 100*c* of FIG. 6. At step 355, the high frequency noise signal is obtained and at step 360 it is applied to the row on-time pulse for an ith row of a frame. A progressive or interlaced scan may be performed. At step 365, a correction value from the memory resident correction table 60 may also be introduced to the row's on-time pulse. At step 370, the corrected row on-time pulse is then used to drive the ith row.

If this is not the last row of the frame, then step 355 is entered for the next row. If the frame is complete, then step 375 is entered where the appropriate frame control signals are reset to allow vertical blanking, etc. If more frames are required, then step 355 is entered again.

Techniques for Altering the Row On-Time Pulse

Figure 8A:
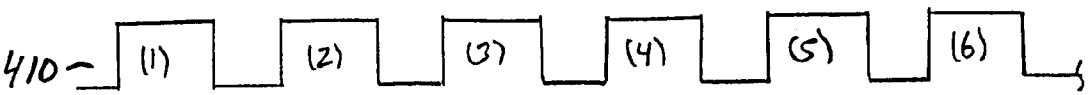
FIG. 8A illustrates normal, uncorrected, row on-time pulses for a series of sequential rows.
Figure 8B:
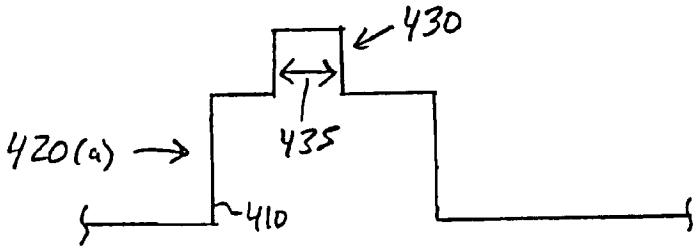
FIG. 8B, FIG. 8C and FIG. 8D illustrate three embodiments of the present invention for providing row on-time pulse adjustment and shaping to provide row-to-row brightness correction.

The row on-time pulse may be modified or shaped using a number of different techniques in order to achieve the brightness corrections described herein. FIG. 8A illustrates a set of uncorrected row on-time pulses 410. In one embodiment of the present invention, a small pulse (correction pulse, top hat pulse) of fixed amplitude, is added to the amplitude of the row on-time pulse in order to provide brightness control. FIG. 8B illustrates an embodiment wherein the correction pulse 430 is added, by the correction circuit 70, to an uncorrected row on-time pulse 410 to create a composite or corrected pulse 420(*a*). The pulse width 435 of the correction pulse 430 is varied depending on the correction value from the memory resident correction table. If brightness needs to be increased for an ith row, then the width of the correction pulse 430 is increased. Conversely, if brightness needs to be decreased for an ith row, then the width of the correction pulse 430 is decreased. The correction pulse 430 may be placed in any location (e.g., right or left) with respect to the uncorrected row on-time pulse 410, and as shown in FIG. 8B, the pulse is generally located in the middle of the uncorrected pulse 410 in a preferred embodiment.

Figure 8C:
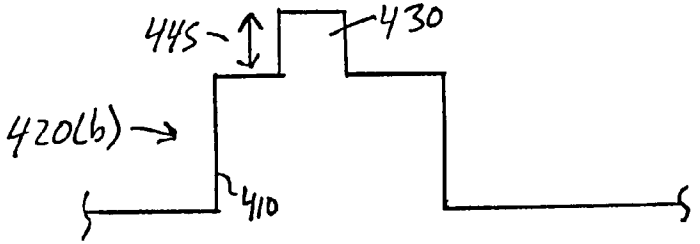

FIG. 8C illustrates that in another embodiment of the present invention, the pulse width of the correction pulse 430 remains constant, but its amplitude 455 is varied depending on the brightness correction required as indicated by the correction value from the memory resident correction table. The composite signal pulse 420(*b*) is shown. If brightness needs to be increased for an ith row, then the amplitude of the correction pulse 430 is increased by the correction circuit 70. Conversely, if brightness needs to be decreased for an ith row, then the amplitude of the correction pulse 430 is decreased by the correction circuit 70. The correction pulse 430 may be placed in any location (e.g., right or left) with respect to the uncorrected row on-time pulse 410, and as shown in FIG. 8C, the pulse is generally located in the middle of the uncorrected pulse 410 in a preferred embodiment.

Alternatively, both the amplitude 445 and the pulse width 435 of the correction pulse 430 may be altered based on the correction value stored in the memory resident correction table for a given row.

Figure 8D:
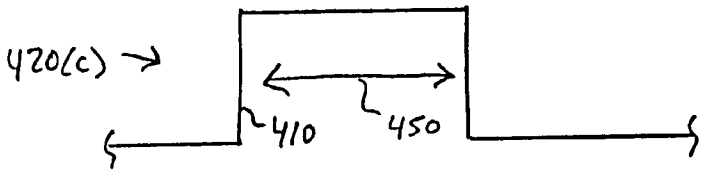

FIG. 8D illustrates that in another embodiment of the present invention, the pulse width 450 of the uncorrected row on-time pulse is varied by the correction circuit 70 depending on the brightness correction required as indicated by the correction value from the memory resident correction table. No top hat pulse is used. In an alternative embodiment, the amplitude of the row on-time pulse may also be varied depending on the brightness correction required as indicated by the correction value from the memory resident correction table. Again, no top hat pulse is used It is appreciated that fundamentally, all of the embodiments of FIGS. 8B–8D alter the area under the row on-time pulse in order to provide brightness correction row-to-row. Any of these row on-time adjustments may be employed in the display processes of FIG. 5 and FIG. 7 and the correction table generation process of FIG. 4. With respect to FIG. 4, step 240 may be modified so that the high pass filter 620 (see FIG. 10) is applied to the measured current values and the difference between the two are stored as correction values in the memory correction table.

FIG. 9 illustrates an exemplary memory resident correction table 60 in accordance with an embodiment of the present invention. According to this embodiment, a separate correction value 520 is provided for each row of the display. The correction values may be stored digitally and may be indexed by the row number.

Figure 10:
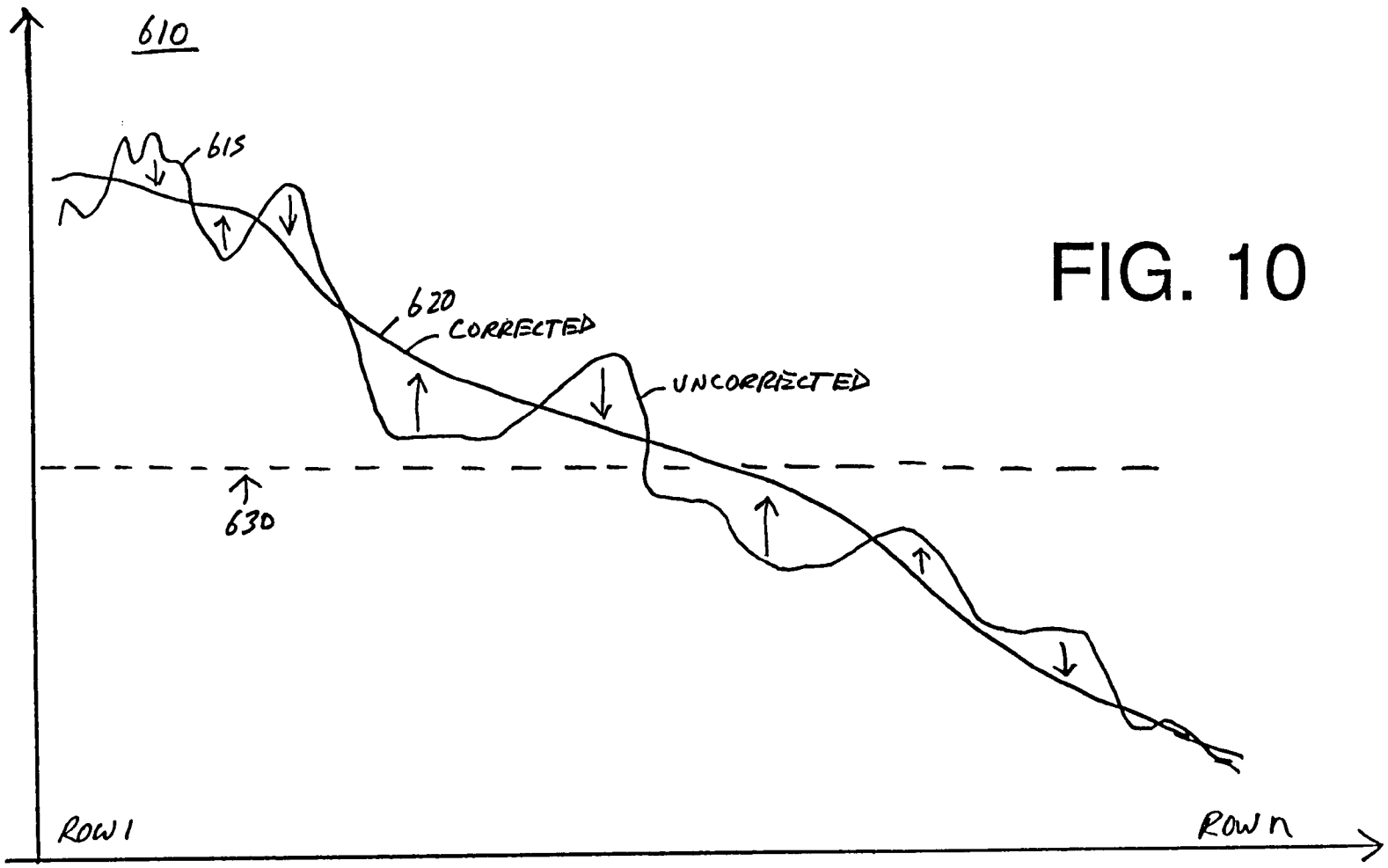
FIG. 10 is a graph of current versus row number illustrating an uncorrected brightness profile for an FED device and a corrected profile in accordance with an embodiment of the present invention.

FIG. 10 illustrates a graph of current along the vertical and row number along the horizontal. Graph 615 represents the current measurements of the n rows taken using the methods described herein. The current measurements illustrate that a general trend of current fall off from row 1 to row n exists. This illustrates that the overall brightness of the FED display gradually varies from brighter to dimmer from the top to the bottom across the face of FED display. Generally, large brightness trends that are gradual from the top to the bottom of the display are not perceptible by the human eye. However, large brightness changes from row-to-row are very perceptible and vivid to the human eye.

As a result of this physical phenomena, it is better to apply a filter 620 (e.g., a high pass filter) to correct the row brightness variations than to force each row to be of the same fixed brightness degree as represented by level line 630. In other words, the amount of correction required to obtain a fixed brightness degree 630 is much more than the amount required to maintain the filter 620. The filter 620 provides good row-to-row localized brightness normalization. The filter 620 also better matches the eye's sensitivity and eliminates large variations between rows that are close to each other, but does not attempt to correct the overall trend of the current profile (most often called "fade").

Therefore, the present invention applies a filter 620 (e.g., a high pass filtered correction table) to adjust or correct regional row brightness variations rather than forcing each brightness value to a predetermined fixed amount 630. This provides localized or regional brightness normalization while allowing a general and imperceptible brightness trend to exist across the face of the FED display. One embodiment of the present invention applies a correction of low range (e.g., the small up and down arrows) which provides localized row-to-row brightness normalization. The low range correction requires less memory as the correction values are smaller than they would be if each row was forced to some fixed brightness amount 630, as is shown by the graphs of FIG. 10. Therefore, what is stored in the correction table 60, for each row, are the differences between the uncorrected graph 615 and the corrected graph 620 in accordance with one embodiments of the present invention.

Figure 11:
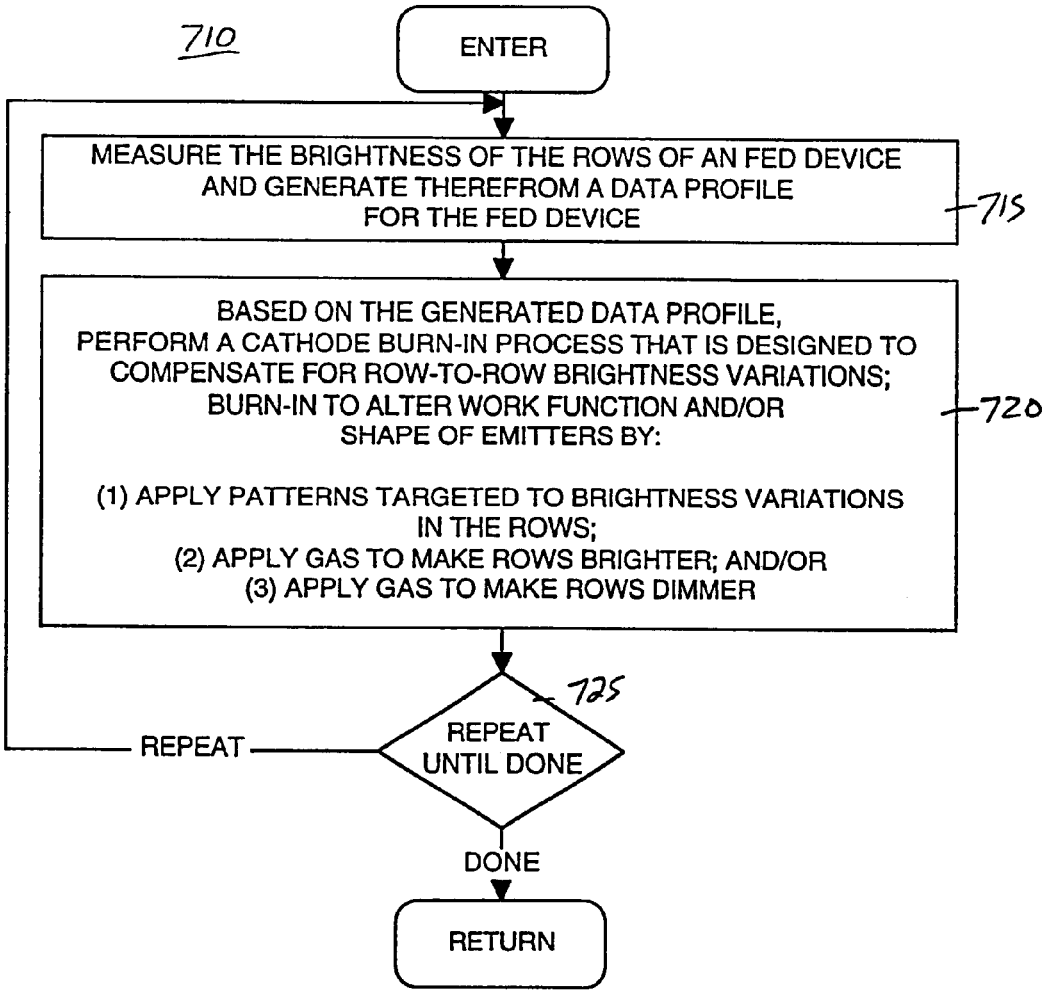
FIG. 11 is a flow diagram illustrating steps of a process in accordance with an embodiment of the present invention for using cathode burn-in processes to correct for row-to-row brightness variations within an FED device.

Embodiment Performing Physical Correction of Brightness Variations Row-to-Row The embodiment described with respect to FIG. 11 is a method for physically altering the emitters of the FED to correct for brightness variations row-to-row. Generally, the using row-by-row current measurements described above, a map can be generated of the current profile of the cathode before and during burn-in. Using this information, during cathode burn-in, display patterns can be applied that vary the amount of time each row is on to reduce or eliminate the cathode current variations from row-to-row or regionally reduce or eliminate them. Because there is significant change in the operating voltage during the initial cathode burn in, the emission current can be significantly changed by sending a non uniform data pattern to the column drivers during this initial stage.

FIG. 11 illustrates a process 710 regarding this embodiment of the present invention. At step 710, the brightness of each row is measured. The brightness may be measured using the electronic current measurement methods described herein. Alternatively, the brightness may be optically measured by presenting the FED display with an optical measuring device which directly measures the relative brightness of each row. In either case, a data profile is recorded that includes a brightness value for each row. Alternatively, a deviation from a norm or a filter may be recorded for each row.

At step 720, the measured data profile obtained from step 710 is used to varying the cathode burn-in process in order to correct for the brightness variations. In effect, the physical properties of the emitters can be altered during burn-in to make rows dimmer or brighter, as the case requires. By varying the amount that a row is driven, or varying the environment in which the row is driven, the work function of the emitter may be altered. Additionally, the shape and size of the emitter tip may be altered. Also, the chemical composition of the emitter tip may be altered during cathode burn-in. These physical changes will alter the amount of electrons emitted from a row and therefore may alter its brightness.

Therefore, during the burn-in process, row-to-row variations can be performed to vary the brightness of individual rows. For instance, row specific display patterns may be used that are targeted to the brightness variations detected in step 710. Just driving a row during cathode burn-in for predetermined time periods may alter its brightness. Gas may also be applied to alter the brightness of a row. For instance, driving a row in the presence of oxygen may make the row dimmer. Alternatively, driving a row in the presence of methane may make the row brighter. These variations may be performed during cathode burn-in based on the data profile.

After an initial cathode burn-in process, step 725 is entered. Step 715 is repeated such multiple measurements and adjustments may be performed to more refine the brightness normalization. At step 725, if a threshold matching amount is reached, then process 710 exists.

The present invention, methods and systems for providing row-to-row brightness corrections in an FED device, have thus been disclosed. It should also be appreciated that, while the present invention has been described in particular embodiments, the present invention should not be construed as limited by such embodiments, but rather construed according to the below claims.

What is claimed is:

1. In a field emission display (FED) device comprising: rows and columns of emitters; and an anode electrode, a method of measuring display attributes of said FED device comprising the steps of:

a) in a scan fashion, individually driving each row and measuring the current drawn by each row, wherein a settling time is allowed after each row is driven;

b) measuring a background current level during a vertical blanking interval;

c) correcting current measurements taken during said step a) by said background current level to yield corrected current measurements;

d) averaging multiple corrected current measurements taken over multiple display frames to produce averaged corrected current values for all rows of said FED device;

e) generating a memory resident correction table based on said averaged corrected current values; and f) measuring an RC decay function of said FED device at the last driven row of a frame; and g) using said RC decay function to further correct values of said memory resident correction table.

2. A method as described in claim 1 wherein said step a) comprises the steps of:

a1) in a first frame, sequentially driving odd rows and measuring said current drawn by each odd row;

a2) simultaneous with said step a1) sequentially not driving even rows to create settling times between said odd rows;

a3) in a second frame, sequentially driving even rows and measuring said current drawn by each even row; and a4) simultaneous with said step a3), sequentially not driving odd rows to create settling times between said even rows.

3. A method as described in claim 1 wherein said steps a)–e) are performed each time said FED device is turned on as part of an initialization and calibration sequence.

4. A method as described in claim 1 wherein said current is measured at said step a) for a given row by measuring the current at said faceplate in time correlation with driving said given row.

5. A method as described in claim 1 comprising the step of individually driving each row in a progressive scan fashion to display an image on said FED device, wherein said memory resident correction table is used to adjust the relative brightness of each row to a uniform level.

6. A method as described in claim 5 wherein the row driving voltage is adjusted, for each row, by said memory resident correction table.

7. A method as described in claim 5 wherein the row on-time period is adjusted, for each row, by said memory resident correction table.

8. A method as described in claim 1 comprising the step off) individually driving each row in a scan fashion to display an image on said FED device, wherein said memory resident correction table is used to adjust the relative brightness of each row to a uniform level and wherein step f) comprises the steps of:

f1) generating a correction signal that is periodic in nature;

f2) adding said correction signal to a row driving pulse to generate a corrected row driving pulse, wherein said row driving pulse is adjusted by said correction table;

f3) using said corrected row driving pulse to drive a row of said rows for a row on-time period; and f4) generating a display frame by repeating steps f1)–f3) for each of said rows.

* * * * *